US010358953B2

(12) United States Patent
Leblay et al.

(10) Patent No.: US 10,358,953 B2
(45) Date of Patent: Jul. 23, 2019

(54) VALVE

(71) Applicant: DELPHI AUTOMOTIVE SYSTEMS LUXEMBOURG SA, Luxembourg (LU)

(72) Inventors: Arnaud Leblay, Beuveille (FR); Eric Bourniche, Preutin-Higny (FR); Rodrigue Berhin, Arlon (BE)

(73) Assignee: DELPHIA AUTOMOTIVE SYSTEMS LUXEMBOURG SA (LU)

( * ) Notice: Subject to any disclaimer, the term of this patent is extended or adjusted under 35 U.S.C. 154(b) by 2 days.

(21) Appl. No.: 15/746,065

(22) PCT Filed: Jun. 27, 2016

(86) PCT No.: PCT/EP2016/064890
§ 371 (c)(1),
(2) Date: Jan. 19, 2018

(87) PCT Pub. No.: WO2017/012832
PCT Pub. Date: Jan. 26, 2017

(65) Prior Publication Data

US 2018/0355766 A1 Dec. 13, 2018

(30) Foreign Application Priority Data

Jul. 20, 2015 (GB) ..... 1512687.3

(51) Int. Cl.
*F01L 1/344* (2006.01)
*F01L 1/053* (2006.01)

(52) U.S. Cl.
CPC ..... *F01L 1/3442* (2013.01); *F01L 1/053* (2013.01); *F01L 2001/0537* (2013.01);
(Continued)

(58) Field of Classification Search
CPC ..... F01L 2001/34426; F01L 2001/3443; F01L 2001/34433; F01L 1/46
(Continued)

(56) References Cited

U.S. PATENT DOCUMENTS 8,225,818 B1 7/2012 Stephens et al.
2008/0271689 A1* 11/2008 Konias ..... F01L 1/34 123/90.17
(Continued)

FOREIGN PATENT DOCUMENTS

GB 2164395 A 3/1986
JP 04365979 A 12/1992
WO 2008025808 A1 3/2008

*Primary Examiner* — Jorge L Leon, Jr.
(74) *Attorney, Agent, or Firm* — Joshua M. Haines

(57) ABSTRACT

A valve for restricting flow through an opening of a control valve in a vehicle engine includes a tubular shell having a central axis that extends between open ends of the shell. The shell also includes a base and a blocking element having an interior surface exposed to an internal space of the shell and an exterior surface exposed to an exterior space surrounding the shell. The blocking element is connected to the base by a deflectable connector such that the blocking element can be deflected towards the central axis in response to fluid pressure acting on the exterior surface, and away from the central axis in response to fluid pressure acting on the interior surface so as to selectively block the opening.

12 Claims, 5 Drawing Sheets

(52) U.S. Cl.
CPC ..... *F01L 2001/34426* (2013.01); *F01L 2001/34433* (2013.01); *F01L 2001/34483* (2013.01); *F01L 2101/00* (2013.01); *F01L 2103/00* (2013.01)

(58) Field of Classification Search
USPC ..... 123/90.17
See application file for complete search history.

(56) References Cited

U.S. PATENT DOCUMENTS

| | | | | |
|---|---|---|---|---|
| 2010/0243085 | A1* | 9/2010 | Van Weelden ..... | F15B 13/0402 137/544 |
| 2012/0042843 | A1* | 2/2012 | Kubota ..... | F01L 1/185 123/90.55 |
| 2012/0073535 | A1* | 3/2012 | Hoppe ..... | F01L 1/34 123/188.4 |
| 2013/0019830 | A1* | 1/2013 | Hoppe ..... | F01L 1/34 123/90.17 |
| 2013/0199634 | A1* | 8/2013 | Hoppe ..... | F16K 17/00 137/513.7 |
| 2014/0256486 | A1 | 9/2014 | Lunk et al. | |
| 2016/0201822 | A1* | 7/2016 | Takada ..... | F01L 1/3442 251/129.15 |
| 2018/0003090 | A1* | 1/2018 | Koehler ..... | F01L 1/344 |

* cited by examiner

VALVE

CROSS REFERENCE TO RELATED APPLICATIONS

This application is a national stage application under 35 USC 371 of PCT Application No. PCT/EP2016/064890 having an international filing date of Jun. 27, 2016, which is designated in the United States and which claimed the benefit of GB Patent Application No. 1512687.3 filed on Jul. 20, 2015, the entire disclosures of each are hereby incorporated by reference in their entirety.

FIELD OF THE INVENTION

The present disclosure relates to a valve for use in a control valve in a vehicle engine. The invention also relates to a control valve incorporating the valve.

BACKGROUND OF THE INVENTION

Cam phasers are used to control the angular relationship of the pulley/sprocket to the camshaft of an engine. A variable cam phaser (VCP) allows the phase relationship to change while the engine is running. Typically, a cam phaser is used to shift the intake cam on a dual overhead cam engine in order to broaden the torque curve of the engine, to increase peak power at high rpm, and to improve the idle quality. Also, the exhaust cam can be shifted by a cam phaser in order to provide internal charge diluent control, which can significantly reduce HC and NOx emissions, or to improve fuel economy.

Cam phasers are controlled by hydraulic systems, which use pressurised lubrication oil from the engine in order to change the relative position between camshaft and crankshaft, by rotating the camshaft towards advance or retard positions, thus altering the valve timing.

To control rotation of the camshaft the cam phaser is provided with two chambers that receive oil: an advance chamber and a retard chamber. To rotate the camshaft in the advance direction, oil is pumped out of the retard chamber and into the advance chamber, and to rotate the camshaft in the retard direction, oil is pumped out of the advance chamber and into the retard chamber.

The flow of oil between the chambers, and hence the rotation of the cam shaft, is generated by the cam shaft torque oscillations and is controlled via an oil control valve (OCV). The OCV typically consists of a housing that has an advance port leading to the advance chamber and a retard port leading to the retard chamber. A spool is movable within the housing to route oil between the ports. The spool has an internal cavity with an oil port that receives oil from the engine and openings that communicate with the advance and retard ports of the housing to allow oil to flow between the chambers.

To control the flow of fluid into and out of the spool, one opening of the spool is typically provided with a unidirectional valve such as a ball-valve or spring valve that permits flow of oil in one direction only, for example into the internal cavity of the spool, but not out of the internal cavity of the spool. The spool can be moved so that the valve is located at different ports, thereby controlling the direction flow of oil into and out of the ports.

However, such valves tend to be bulky, and add considerably to the overall size of the OCV, and/or reduce the flow capacity of the OCV.

It is also desirable in OCVs to isolate the engine oil supply from the oil in the spool. Oil in the OCV tends to become pressurised during use and high pressure oil could flow in a reverse direction back up the oil port into the engine, which would result in a loss of pressure, and hence diminishing the phase rate performance of the cam phasing system. Check valves can be integrated into the OCV to prevent this reverse flow of oil; however, these check valves are also bulky, and add to the size and weight of the OCV.

Against this background it is an object of the invention to address at least one of the problems associated with known OCVs.

STATEMENTS OF INVENTION

According to one aspect of the invention, there is provided a valve for restricting flow through an opening of a control valve in a vehicle engine. The valve has a body comprising a tubular shell having a central axis that extends between the open ends of the shell. The shell comprises a base and a blocking element having an interior surface exposed to an internal space of the shell and an exterior surface exposed to an exterior space surrounding the shell. The blocking element is connected to the base by a deflectable connector such that the blocking element can be deflected towards the central axis in response to fluid pressure acting on the exterior surface, and away from the central axis in response to fluid pressure acting on the interior surface so as to selectively block the opening when the valve is in use.

Because the body of the valve is comprised of a thin shell, the valve takes up only a very small amount of space inside the internal chamber of the control valve, and does not add to the diameter of the control valve, or interfere with the volume of the internal chambers of the control valve. Thus, the size of the control valve can be reduced compared to conventional control valve whilst still retaining the same volume in the internal chamber and hence the same flow of fluid through the control valve. The valve therefore allows for a particularly compact design that still permits a high flow of fluid through the control valve, and that still provides definitive switching between open and closed states.

The blocking element may comprise a petal on which fluid pressure can act to deflect the blocking element towards or away from the central axis. A petal provides a high surface area and therefore a high force acting on the surface of the blocking element, resulting in a large degree of deflection that allows for definitive switching of the valve.

At least one opening may be defined between the blocking element and the base. Such openings allow fluid to flow particularly easily between the blocking element and the base, thereby minimising interference of the valve with the fluid flow when the opening of the valve is unblocked.

For simplicity of design, the connector may comprise at least one spring arm. The connector may comprise a pair of spring arms that extend away from the blocking element in a circumferential direction. Using a pair of spring arms means that the blocking element can be particularly securely connected to the base at two connection points, whilst still permitting deflection of the blocking element.

The spring arms may diverge moving away from the blocking element towards opposite ends of the tubular shell. In this way, the blocking element may effectively be suspended between the two ends of the shell.

The shell may comprise a plurality of blocking elements for blocking a plurality of openings, each blocking element being connected to the base by a deflectable connector. In embodiments comprising a plurality of blocking elements and in which the connector comprises a pair of diverging spring arms, each blocking element may be nested between the diverging spring arms connected to a neighbouring blocking element of the shell. Nesting the blocking elements in this way allows for a compact design, whilst maintaining long spring arms. Long spring arms are advantageous as they provide a higher level of deflection for a given force than shorter spring arms, allowing for more definitive switching between the open and closed states of the valve.

For compactness of design, the base may be constituted by one or more bands that surround one or both open ends of the shell.

The or each blocking element may be elongate along a circumferential direction of the tubular shell. In this way each blocking element may be used to block an opening that is correspondingly elongate in a circumferential direction. Such elongate openings are advantageous as they allow flow of a higher volume of fluid than circular openings.

The or each connecting element may be curved around a circumference of the shell, and may be configured such that a curvature of the connecting element increases when the blocking element is deflected towards the central axis of the shell. In this way, the or each connecting element may effectively coil more tightly as the blocking element is deflected towards the central axis, and may uncoil as the blocking element is deflected away from the central axis.

The tubular shell may be substantially cylindrical, for example to lie flush against an interior surface of a cylindrical chamber.

The base, connector and blocking element may lie substantially flush when no fluid pressure acts on the interior or exterior surface of the or each blocking element. In this way, the valve may be biased into a substantially closed position when no forces act on the valve.

The invention also extends to a control valve for a vehicle engine. The control valve comprises: a housing having advance and retard ports for communication with respective advance and retard chambers of the cam phaser; a spool having an internal chamber with a plurality of openings for communication with the advance and retard ports of the housing, the openings including a first opening, a second opening and valve opening located between the first and second openings; and a valve as described above disposed in the internal chamber of the spool with the interior surface of the blocking element exposed to the internal chamber and the exterior surface of the blocking element exposed to the valve opening, such that, in response to fluid pressure in the valve opening, the blocking element is deflected towards the central axis to allow fluid to flow from the valve opening into the internal chamber, and in response to fluid pressure in the internal chamber the blocking element is deflected away from the central axis to block the valve opening and guard against fluid flowing from the internal chamber into the valve opening. The spool is movable within the housing between a retard position in which the valve opening of the spool is in communication with the advance port of the housing, and the second opening of the spool is in communication with the retard port of the housing to permit fluid flow from the advance chamber to the retard chamber but to guard against fluid flow from the retard chamber to the advance chamber, and an advance position in which the valve opening of the spool is in communication with the retard port of the housing and the first opening of the spool is in communication with the advance port of the housing to permit fluid flow from the retard chamber to the advance chamber but to guard against fluid flow from the advance chamber to the retard chamber.

In embodiments where the or each blocking element is elongate along a circumferential direction of the tubular shell, the valve opening may be elongate in the circumferential direction of the tubular shell. In this way the opening may have an oval-shaped cross section which allows a greater flow of fluid through the opening.

The spool may comprise a fluid inlet, in which case the control valve may comprise a further valve as described above provided between the internal chamber of the spool and the fluid inlet such that the interior surface of the blocking element is exposed to fluid in the internal chamber, and the exterior surface of the blocking element is exposed to fluid in the fluid inlet, so that the blocking element can be deflected towards the central axis in response to fluid pressure in the fluid inlet to allow fluid to flow from the fluid inlet into the internal chamber of the spool, and can be deflected away from the central axis to block the fluid inlet in response to fluid pressure in the internal chamber to guard against fluid flowing from the internal chamber into the fluid inlet. In this way, the valve can also be used to prevent back-flow of fluid into the engine.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment or aspect can be combined in any way and/or combination, unless such features are incompatible.

BRIEF DESCRIPTION OF THE DRAWINGS

One or more embodiments of the invention will now be described, by way of example only, with reference to the accompanying drawings, in which.

DETAILED DESCRIPTION OF EMBODIMENTS OF THE INVENTION

Figure 1:
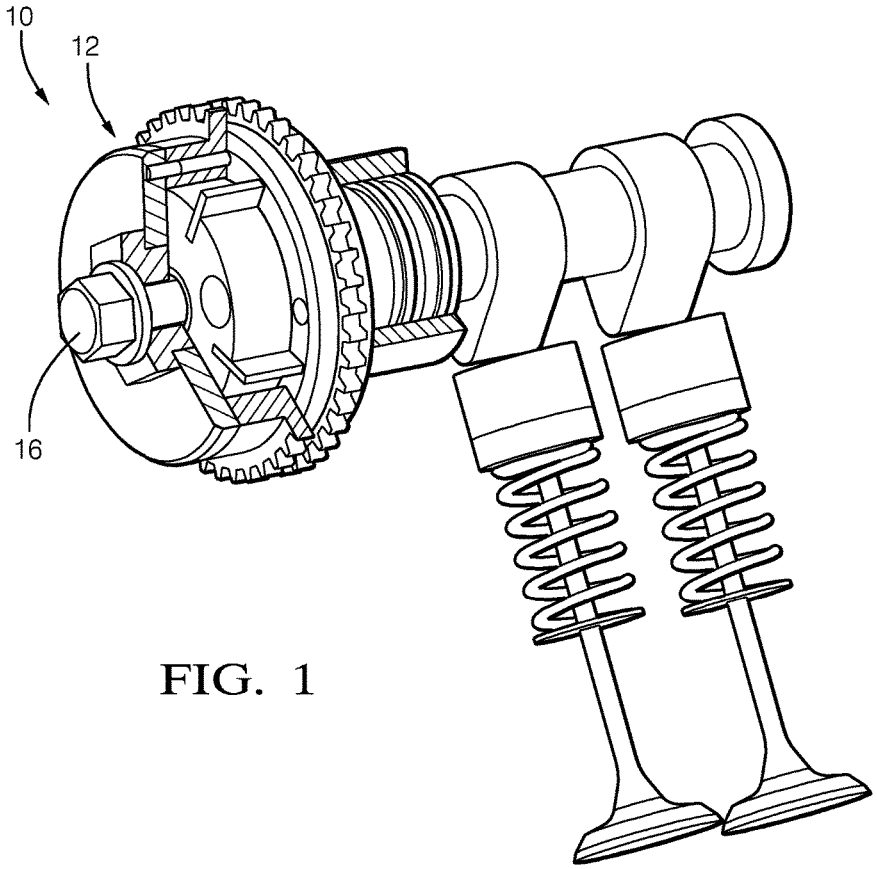
FIG. 1 is a perspective view of a cam phaser assembly controlled by an oil control valve with which a check valve of the invention may be used.

FIG. 1 shows a cam phaser assembly 10. The cam phaser assembly 10 comprises a cam phaser 12 that drives a cam shaft. Inside the cam phaser 12 are two chambers: an advance chamber and a retard chamber (not visible). A bolt 16 is incorporated into the cam phaser assembly 10 at the axis of rotation of the cam shaft. A control valve in the form of an oil control vale (OCV) 20 is incorporated into the bolt 16 and controls a flow of fluid between the advance and retard chambers of the cam phaser 12 to rotate the cam phaser 12 in the advance or retard directions.

Figure 2:
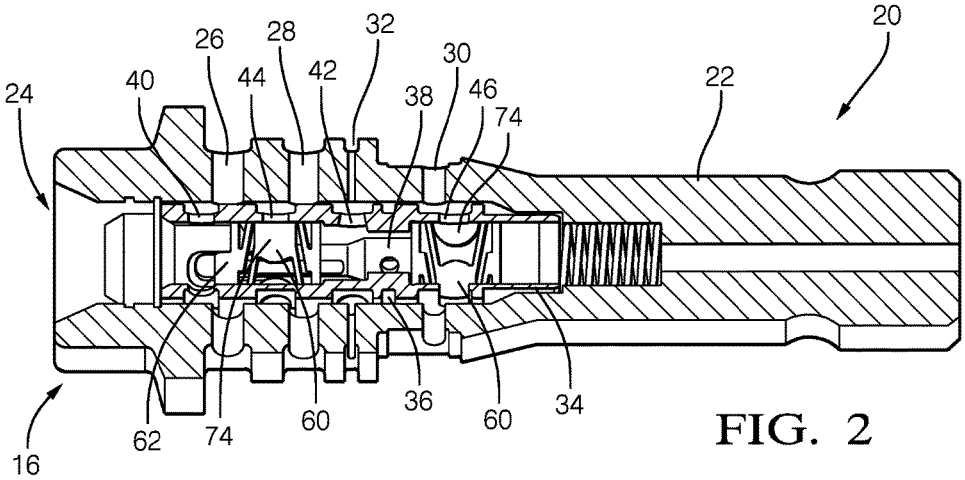
FIG. 2 is a section view of a bolt with an embedded oil control valve incorporating the check valve of the invention, with a spool of the oil control valve in a first position.

FIG. 2 shows the bolt 16 and the incorporated OCV 20. The OCV 20 comprises a housing 22, in this case defined by the bolt 16, having an internal cavity 24. Sets of radial openings 26, 28, 30, 32 define ports that open into the internal cavity 24. In this example, each set comprises three radial openings. An advance port 26 leads to the advance chamber of the cam phaser 12, and the retard port 28 leads to the retard chamber of the cam phaser 12. An oil port 30 leads to the engine oil supply to receive high-pressure oil from the engine. A vent port 32 is connected to a vent or drain.

A spool 34 is reciprocally received in the internal cavity 24 of the housing 22. The spool 34 comprises a body 36 defining an internal chamber 38. The internal chamber 38 is of substantially circular cross-section. Sets of radial openings 40, 42, 44, 46 connect the internal chamber 38 to an exterior of the spool 34, and in this example each set comprises three openings to correspond to the number of openings in the housing 22 of the OCV 20. The radial openings 40, 42, 44, 46 of the spool 34 are arranged to communicate with the radial openings 26, 28, 30, 32 of the housing, so as to provide flow paths for oil from the advance chamber to and from the retard chamber, and between the spool 34 and the engine oil source and the drain.

More specifically, a set of first radial openings 40 is provided at the left-most side of the spool 34 as shown in FIG. 2, towards an end that is remote from the oil port 30 of the housing 22. The first openings 40 can communicate with the advance ports 26 of the housing 22. A second set of radial openings 42 in the spool 34 can communicate with the retard ports 28 of the housing 22. Between the first and second openings 40, 42 is a set of radial valve openings 44 that can be arranged to communicate with either the advance ports 26 or the retard ports 28. To the right of the first, second and valve openings 40, 42, 44 is a set of oil inlets 46 that communicate with the oil ports 30 of the housing 22.

The openings 40, 42, 44, 46 in the housing 22 are each elongate in a circumferential direction. In this way, the openings 40, 42, 44, 46 each have a substantially oval cross-section. This oval cross-section allows for a higher flow area than a circular opening, and hence a greater flow of fluid through the openings.

The valve opening 44 and oil inlet 46 are each provided with a valve 60. The valve 60 is generally tubular, and is located in the internal chamber 38 of the spool 34 such that an exterior surface 62 of the valve 60 lies against an interior surface 48 of the spool 34. The valve 60 is a unidirectional valve that permits fluid to flow into the internal chamber 38 of the spool 34, but guards against fluid flowing out of the internal chamber 38 of the spool 34. The valve opening 44 and oil inlet 46 therefore acts as inlets only, while the first and second openings 40, 42, which do not have a valve, can act as both inlets and outlets.

The valve 60 will now be described in more detail with reference to FIGS. 3, 4 and 5.

The valve 60 comprises a body 64 that defines a tubular shell. In this example, the tubular shell is cylindrical, and the shell has a thickness of approximately 0.1 mm. The shell 64 encloses an internal space 66. Ends 68, 70 of the shell 64 are open and a central axis A extends between the open ends 68, 70. Because the ends 68, 70 are open, oil can flow through the shell 64 in a direction generally parallel to the central axis A.

The shell 64 comprises a base 72, a plurality of blocking elements 74, and a plurality of connectors 76 that connect each blocking element 74 to the base 72. The connectors 76 are flexible, such that the blocking elements 74 can be deflected towards and away from the central axis A of the shell 64. In this embodiment the base 72, blocking elements 74 and connectors 76 are integral with one another. The shell may be formed for example by cutting, such as by laser-cutting, a cylindrical shell of a suitable material, such as steel, or the shell may be formed by any other suitable method or from any other suitable material.

The blocking elements 74 are petals that curve around the cylinder in a circumferential direction. The blocking elements 74 have an interior surface 82 that is exposed to the internal space 66 of the valve 60 and an exterior surface 84 that is exposed to an exterior of the valve 60 surrounding the shell 64. Each blocking element 74 is elongate in the circumferential direction to define an oval shape that mimics the cross-section of the valve opening 44 and the fluid inlet 46 of the spool 34. In particular, each blocking element 74 has a footprint that is slightly larger than the cross-section of the valve opening 44 or the fluid inlet 46.

The base 72 is constituted by bands 78, 80 that surround the open ends 68, 70 of the shell to define rims. A first band 78 surrounds a first open end 68, and a second band 80 surrounds a second open end 70. At the first end 68, a tab 86 extends from the first band 78. In use, the tab 86 acts as an alignment feature that fixes the alignment and orientation between block element 74 and valve opening 44.

Each connector 76 is defined by a pair of spring arms 88, 90 that extend between the blocking element 74 and the base 72. The spring arms 88, 90 extend away from a rear end 91 of the blocking element in the same rearward direction around the circumference of the shell 64, which, in this case is to the left of the blocking element 74 as shown in FIG. 3. In this way, the spring arms 88, 90 are curved around the cylinder of the shell in the circumferential direction to define an arc.

The spring arms 88, 90 diverge as they extend away from the blocking element 74. A first spring arm 88 extends towards the first open end 68 of the shell 64 to meet the first band 78, while a second spring arm 90 extends towards the second open end 70 of the shell 64 to meet the second band 80. Openings 92, 94 are defined between the spring arms 88, 90 and the bands 78, 80.

The spring arms 88, 90 are slender, and are of approximately the same width as the bands 78, 80. Because of the slenderness of the arms, a large opening 96 is defined between the spring arms 88, 90 of each pair.

The blocking elements 74 are aligned along the circumferential direction of the shell 64. Spacings 98 are provided between the neighbouring blocking elements. Each blocking element 74 is located in the opening 96 between the spring arms 88, 90 that are connected to a neighbouring blocking element in the stack, so as to be nested between the spring arms 88, 90 of the neighbouring blocking element 74.

Said another way, each spring arm 88, 90 extends rearwardly away from its blocking element 74 along a sufficient length that the spring arm 88, 90 extends beside a rearward neighbouring blocking element 74, between that rearward blocking element 74 and the respective band 78, 80. In this example, each spring arm 88, 90 meets its respective band 78, 80 at a position that is approximately in line with the rear end 91 of its rearward neighbouring blocking element 74. This nested arrangement allows for longer spring arms 88, 90 than would otherwise be possible, which permits easier deflection of the blocking elements 74.

Figure 3:
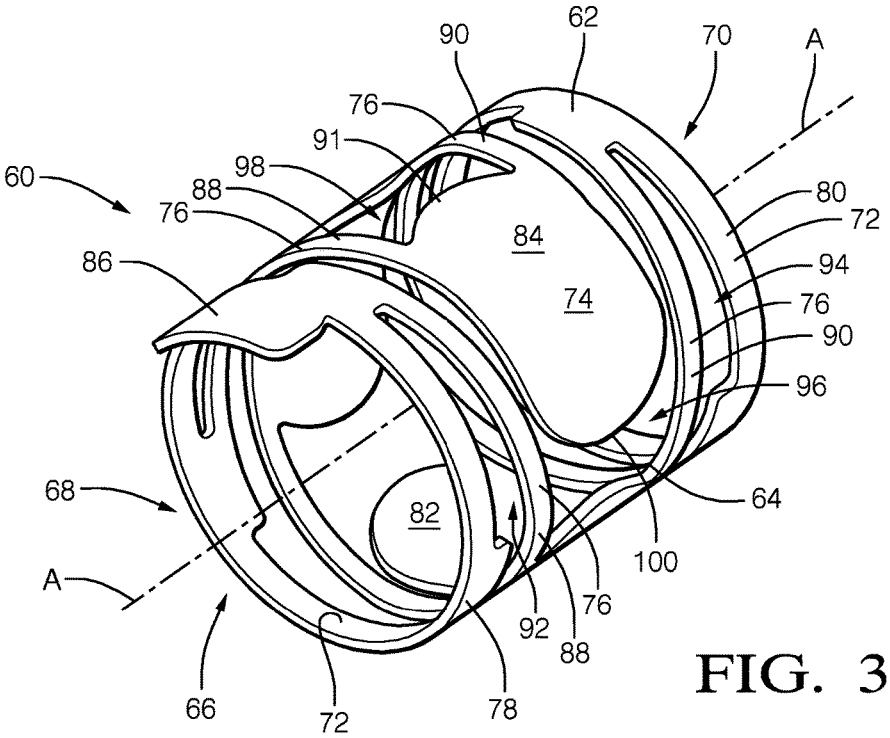
FIGS. 3, 4 and 5 are perspective, front and end views respectively of a check valve according to an embodiment of the invention.
Figure 4:
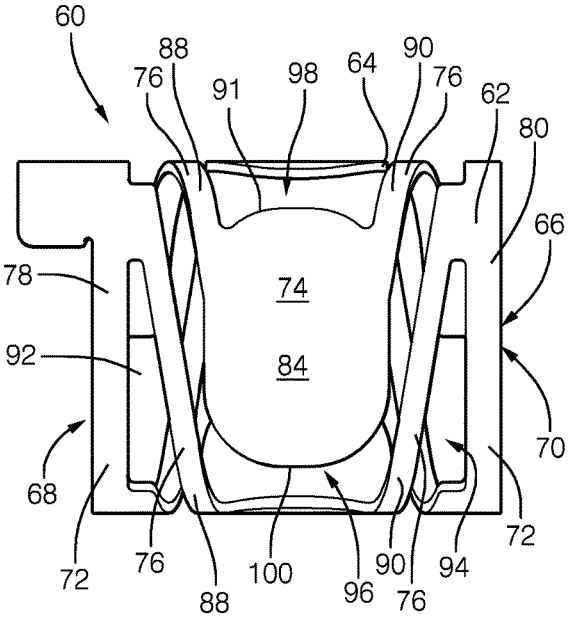
Figure 5:
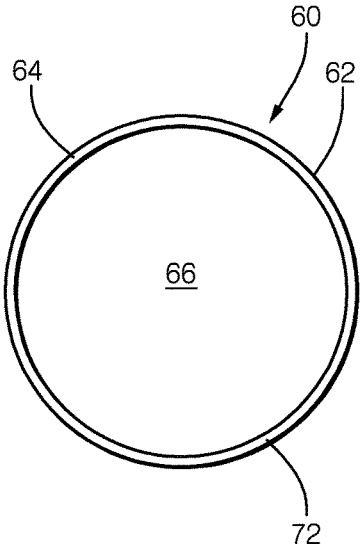

When there is no pressure acting on the blocking elements 74, the blocking elements are biased into the position shown in FIGS. 3, 4 and 5, in which the blocking elements 74, base 72 and spring arms 88, 90 lie substantially flush with one another.

Figure 6:
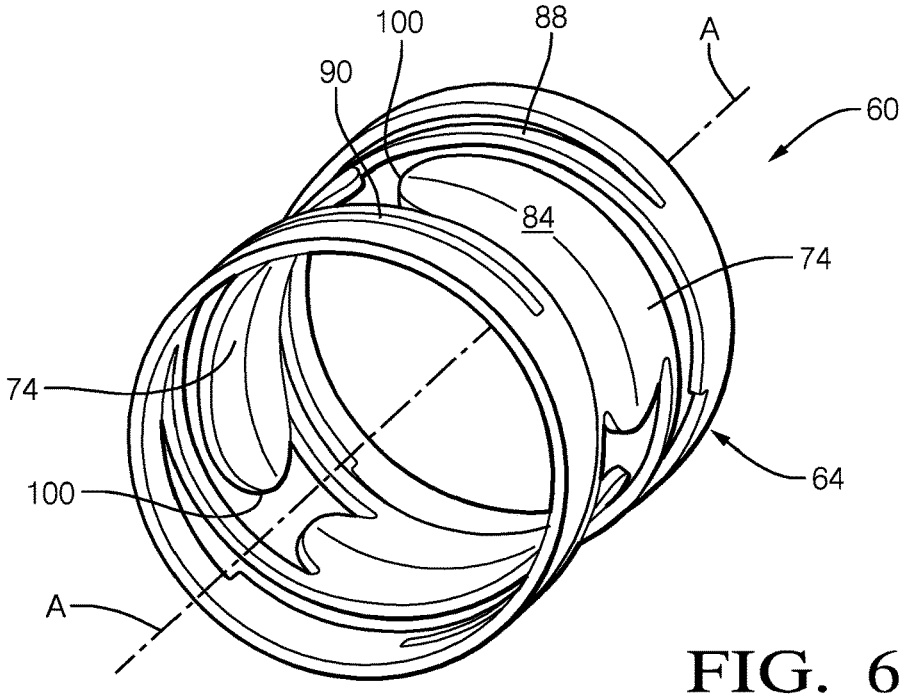
FIGS. 6 and 7 are perspective and end views respectively of the check valve of FIG. 3 with the blocking element of the check valve displaced towards a central axis A of the valve.
Figure 7:
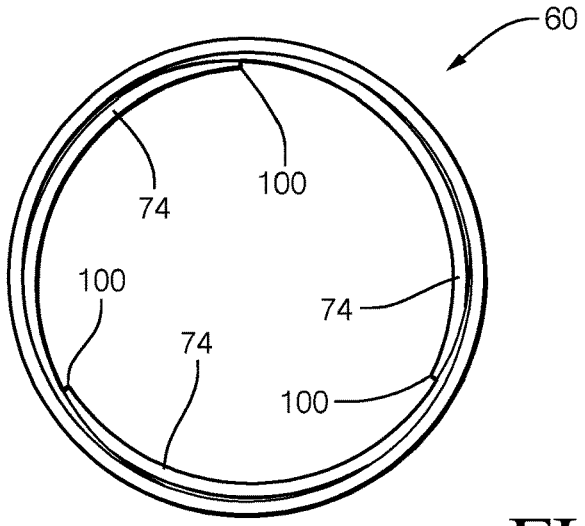

FIGS. 6 and 7 illustrate the valve 60 when the blocking elements 74 have been deflected towards the central axis A of the shell 64. This deflection can be effected, by applying pressure, for example fluid pressure, to the exterior surface 84 of the blocking elements, upon which the blocking elements 74 are deflected against the spring force of the spring arms 88, 90 towards the central axis A.

The deflection of the blocking element 74 causes a deflection of the spring arms 88, 90. The spring arms 88, 90 hinge about the point at which they connect to the bands 78, 80. As the spring arms 88, 90 deflect, and the blocking element 74 moves towards the central axis A, the curvature of the arc defined by the spring arms 88, 90 increases. Thus, as the blocking element 74 is deflected towards the central axis A, the spring arm effectively coils more tightly. In this way, a front end 100 of the blocking element 74, which is furthest from the spring arms 88, 90, is deflected towards the central axis by the largest amount.

When the pressure is removed, the blocking element 74 is displaced away from the central axis A of the shell and the curvature of the arc defined by the spring arms 88, 90 decreases again until the blocking elements 74 return to the configuration shown in FIGS. 3, 4 and 5.

Referring back to FIG. 2, when the valves 60 are integrated into the OCV 20 the blocking elements 74 are located within the spool 34 such that each blocking element 74 is arranged adjacent to a valve opening 44 or a fluid inlet 46. In this way, the interior surface of each blocking element 74 is exposed to fluid in the internal chamber 38 of the spool 34, and the exterior surface of each blocking element 74 is exposed to fluid in the valve opening 44 or in the fluid inlet 46.

FIGS. 8, 9, 10 and 11 show the configuration of the valve 60 when integrated into the OCV 20 at the valve opening 44 during different flow situations.

Figure 8:
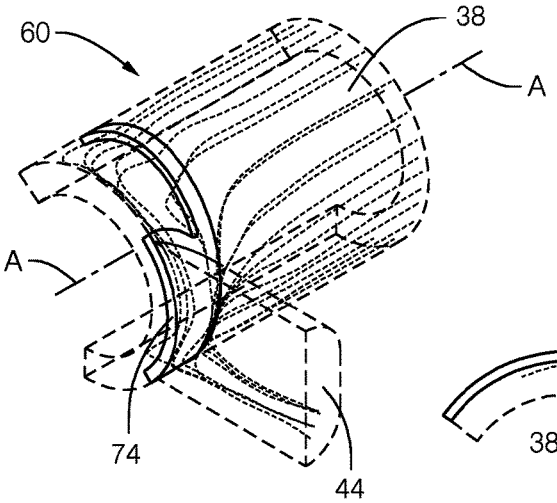
FIGS. 8 and 9 are perspective and end views respectively of the blocking element indicating the leak of fluid when fluid pressure is exerted on an interior surface of the blocking element.
Figure 9:
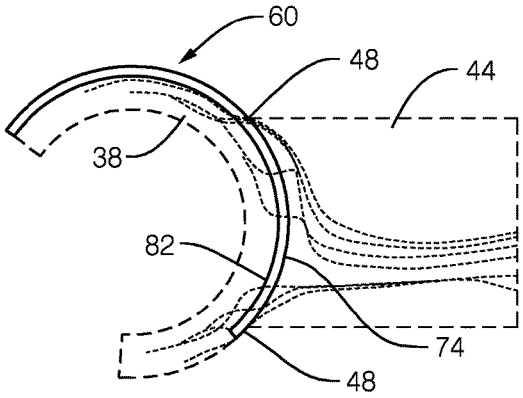

In FIGS. 8 and 9 there is a higher pressure of fluid in the internal chamber 38 of the spool than in the valve opening 44 of the spool. This may be, for example because fluid has been injected into the internal space of the bolt, and hence into the spool, via the oil inlet (not visible in FIGS. 8 and 9). In this case, the fluid in the internal chamber 38 exerts a net pressure on the interior surface 82 of the blocking element 74. This net pressure deflects the blocking element 74 away from the central axis A of the valve 60 and towards the valve opening 44 in the spool 34. Because the blocking element 74 has a footprint that is slightly larger than the cross-section of the valve openings 44, the blocking element 74 abuts against the interior surface 48 of the spool 34 surrounding the valve opening 44 to block the valve opening 44. As can be seen from the flow lines in FIGS. 8 and 9, with the blocking element 74 in this position only a small amount of fluid leakage can flow out of the valve outlet 44.

Figure 10:
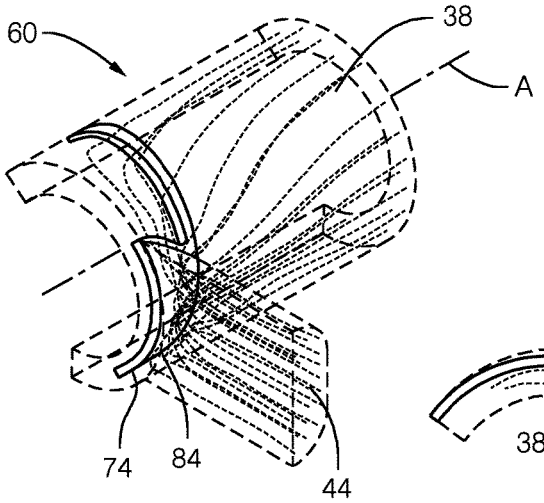
FIGS. 10 and 11 are perspective and end views respectively of the blocking element indicating the flow of fluid when fluid pressure is exerted on an exterior surface of the blocking element.
Figure 11:
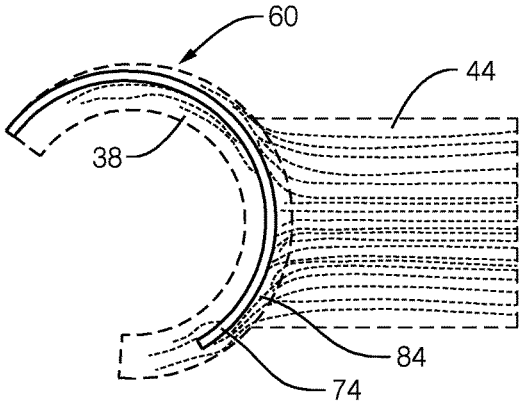

In FIGS. 10 and 11 there is a lower pressure of fluid in the internal chamber 38 of the spool 34 than in the valve opening 44 of the spool. This may be, for example, because fluid has been directed out of the internal space of the OCV, and hence out of the spool, via the drain. In this case, the fluid in the valve opening 44 exerts a net pressure on the exterior surface 84 of the blocking element 74. This net pressure deflects the blocking element 74 towards the central axis A.

As shown by the flow lines in FIGS. 10 and 11, the spacings and openings in the shell 64 allow fluid to flow out of the valve opening 44 and through the shell 64 in a direction transverse to the central axis A, such that the fluid can enter the internal space of the shell 64. Thus, fluid can flow from the valve opening 44 of the spool 34 into the internal space 66 of the shell 64.

Figure 12:
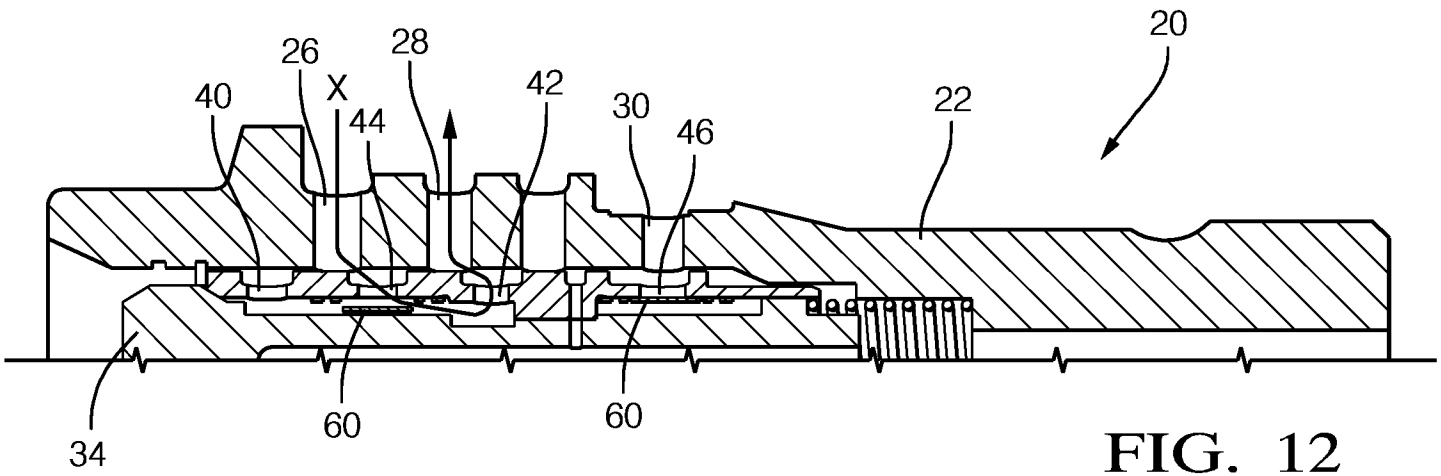
FIGS. 12 and 13 are cross-sectional views of a control valve arranged respectively in a retard position and an advance position.
Figure 13:
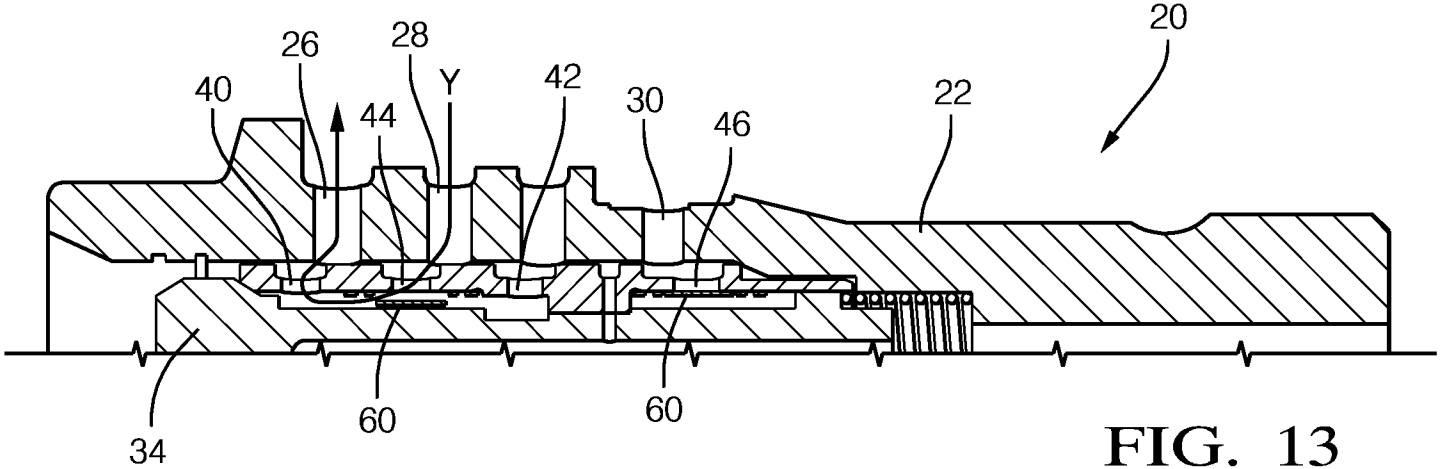

FIGS. 12 and 13 show the spool, 34 and the valve 60 when in use in the OCV 20.

The spool 34 is movable within the housing 22 between a retard position, shown in FIG. 12, and an advance position, shown in FIG. 13.

In the retard position, the valve opening 44 of the spool 34 is in communication with the advance port 26 of the housing 22, and the second opening 42 of the spool 34 is in communication with the retard port 28 of the housing 22. The valve 60 is therefore aligned with the advance port 26 and fluid can flow from the advance port 26 into the spool 34, but cannot flow from the spool 34 into the advance port 26. The second opening 42 of the spool 34, which does not have a valve, is aligned with the retard port 28, such that fluid can flow freely into the retard port 28. In this way, when the spool 34 is in the retard position, the valve 60 permits fluid flow from the advance chamber to the retard chamber in the direction of arrow X, but guards against fluid flow from the retard chamber to the advance chamber.

In the advance position, the valve opening 44 of the spool 34 is in communication with the retard port 28 of the housing and the first opening 40 of the spool 34 is in communication with the advance port 26 of the housing 22. The valve 60 is therefore aligned with the retard port 28 and fluid can flow from the retard port 28 into the spool 34, but cannot flow from the spool 34 into the retard port 28. The first opening 40 of the spool 34, which does not have a valve, is aligned with the advance port 26, such that fluid can flow freely into the advance port 26. In this way, the advance position permits fluid flow from the retard chamber to the advance chamber in the direction of arrow Y, but guards against fluid flow from the advance chamber to the retard chamber.

In both positions, the fluid inlet 46 of the spool 34 aligns with the oil inlet 30 of the housing 22. In both cases, the valve 60 at the fluid inlet 46 acts to permit oil to flow from the oil inlet 30 through the fluid inlet 46 into the internal chamber 38 of the spool 34, and to prevent oil flowing from the internal chamber 38 of the spool 34 through the fluid inlet 46 and back into the oil inlet 30, and hence back into the engine. In this way the valve 60 prevents back-flow of oil and balances pressure peaks in the oil supply from the engine.

Thus, the valve 60 provides an effective means for controlling flow of fluid between the advance and retard ports 26, 28, and for preventing back-flow of fluid into the engine.

Furthermore, because the body 64 of the valve 60 is comprised of a thin cylindrical shell, the valve 60 takes up only a very small amount of space inside the internal chamber 38 of the spool 34. In particular, because the shell is so thin, the valve 60 does not add to the diameter of the OCV, or interfere with the volume of the internal chamber 38. Thus, the size of the bolt with the embedded OCV 20 can be reduced compared to conventional OCVs whilst still retaining the same volume in the internal chamber and hence the same flow of fluid through the embedded OCV 20.

The elongate openings 40, 42, 44, 46 in the spool 34 and the corresponding elongate blocking elements 74 of the valve 60 allow a higher volume of fluid to flow through the spool 34 than would be permitted by circular opening, thereby further increasing the capacity of the valve.

The valve 60 therefore allows for a particularly compact design that still permits a high flow of fluid through the OCV.

Although in the embodiments described the sets of radial openings comprise three openings, and the valve correspondingly comprises three blocking elements, it will be appreciated that any suitable number of openings and blocking elements may be used. For example, the number of openings and blocking elements may be varied according to the size of the spool.

The tubular valve described above could be incorporated into any other control valve of a vehicle, where it may be used to selectively block an opening in the manner described. Although an OCV for use in a variable cam phaser has been used as an exemplary application of the valve described, it will be appreciated that the control valve need not be used to control a variable cam phaser, but may be used for other vehicular applications.

It will be appreciated by a person skilled in the art that the invention could be modified to take many alternative forms without depositing from the scope of the appended claims.

The invention claimed is:

1. A valve for restricting flow through an opening of a control valve in a vehicle engine, the valve comprising a body having a tubular shell with a central axis that extends between open ends of the tubular shell, the tubular shell comprising a base and a blocking element having an interior surface exposed to an internal space of the tubular shell and an exterior surface exposed to an exterior space surrounding the tubular shell, the blocking element being connected to the base by a deflectable connector such that the blocking element deflects towards the central axis in response to fluid pressure acting on the exterior surface, and deflects away from the central axis in response to fluid pressure acting on the interior surface so as to selectively block the opening, the deflectable connector comprising a pair of spring arms that extend away from the blocking element in a circumferential direction; wherein the pair of spring arms diverge moving away from the blocking element towards the open ends of the tubular shell.

2. The valve of claim 1, wherein the blocking element comprises a petal on which fluid pressure acts to deflect the blocking element towards or away from the central axis.

3. The valve of claim 1 wherein at least one opening is defined between the blocking element and the base, such that oil can flow between the blocking element and the base to exit the tubular shell in a direction transverse to the central axis.

4. The valve of claim 1, wherein the tubular shell comprises a plurality of blocking elements which block a plurality of openings, each of the plurality of blocking elements being connected to the base by a respective deflectable connector.

5. The valve of claim 4, wherein each of the plurality of blocking elements is nested between the diverging pair of spring arms connected to a neighbouring blocking element of the tubular shell.

6. The valve of claim 1, wherein the base comprises one or more bands that surround one or both of the open ends of the tubular shell.

7. The valve of claim 1, wherein the blocking element is elongate along a circumferential direction of the tubular shell.

8. The valve of claim 1, wherein the deflectable connector is curved around a circumference of the tubular shell, and is configured such that a curvature of the deflectable connector increases when the blocking element is deflected towards the central axis of the tubular shell.

9. The valve of claim 1, wherein the tubular shell is substantially cylindrical.

10. The valve of claim 1, wherein the base, deflectable connector and blocking element lie flush with one another when no fluid pressure acts on the interior or exterior surface of the blocking element.

11. A control valve for use in a vehicle engine, the control valve comprising:

a housing having advance and retard ports for communication with respective advance and retard chambers of a cam phaser;

a spool having an internal chamber with a plurality of openings for communication with the advance and retard ports of the housing, the plurality of openings including a first opening, a second opening and a valve opening located between the first opening and the second openings; and a valve comprising a body having a tubular shell with a central axis that extends between the open ends of the tubular shell, the tubular shell comprising a base and a blocking element having an interior surface exposed to an internal space of the tubular shell and an exterior surface exposed to an exterior space surrounding the tubular shell, the blocking element being connected to the base by a deflectable connector such that the blocking element deflects towards the central axis in response to fluid pressure acting on the exterior surface, and deflects away from the central axis in response to fluid pressure acting on the interior surface so as to selectively block the valve opening, the deflectable connector comprising a pair of spring arms that extend away from the blocking element in a circumferential direction, the valve being disposed in the internal chamber of the spool with the interior surface of the blocking element exposed to the internal chamber and the exterior surface of the blocking element exposed to the valve opening, such that, in response to fluid pressure in the valve opening, the blocking element is deflected towards the central axis to allow fluid to flow from the valve opening into the internal chamber, and in response to fluid pressure in the internal chamber the blocking element is deflected away from the central axis to block the valve opening and guard against fluid flowing from the internal chamber into the valve opening;

wherein the spool is movable within the housing between a retard position in which the valve opening of the spool is in communication with the advance port of the housing, and the second opening of the spool is in communication with the retard port of the housing to permit fluid flow from the advance chamber to the retard chamber and to guard against fluid flow from the retard chamber to the advance chamber, and an advance position in which the valve opening of the spool is in communication with the retard port of the housing and the first opening of the spool is in communication with the advance port of the housing to permit fluid flow from the retard chamber to the advance chamber and to guard against fluid flow from the advance chamber to the retard chamber.

12. The control valve of claim 11, wherein the spool comprises a fluid inlet, and the control valve comprises a further valve provided between the internal chamber of the spool and the fluid inlet, the further valve comprising a body having a tubular shell with a central axis that extends between the open ends of the tubular shell, the tubular shell comprising a base and a blocking element having an interior surface exposed to an internal space of the tubular shell and an exterior surface exposed to an exterior space surrounding the tubular shell, the blocking element being connected to the base by a deflectable connector such that the blocking element deflects towards the central axis in response to fluid pressure acting on the exterior surface, and deflects away from the central axis in response to fluid pressure acting on the interior surface so as to selectively block the fluid inlet, the deflectable connector comprising a pair of spring arms that extend away from the blocking element in a circumferential direction, wherein the interior surface of the blocking element is exposed to fluid in the internal chamber, and the exterior surface of the blocking element is exposed to fluid in the fluid inlet, so that the blocking element deflects towards the central axis in response to fluid pressure in the fluid inlet to allow fluid to flow from the fluid inlet into the internal chamber of the spool, and is also deflected away from the central axis to block the fluid inlet in response to fluid pressure in the internal chamber to guard against fluid flowing from the internal chamber into the fluid inlet.

* * * * *